US007946786B1

(12) United States Patent
Tullis et al.

(10) Patent No.: US 7,946,786 B1
(45) Date of Patent: May 24, 2011

(54) SEGMENTED MASSIVE SECURITY BARRIERS HAVING TIE-BARS IN TUNNELS

(75) Inventors: Barclay J. Tullis, Palo Alto, CA (US); Roger Allen Nolte, Concord, NC (US); Charles Merrill, Cornelius, NC (US)

(73) Assignee: Kontek Industries, Inc., New Madrid, MO (US)

( * ) Notice: Subject to any disclaimer, the term of this patent is extended or adjusted under 35 U.S.C. 154(b) by 61 days.

(21) Appl. No.: 12/618,701

(22) Filed: Nov. 13, 2009

Related U.S. Application Data

(62) Division of application No. 11/551,155, filed on Oct. 19, 2006, now Pat. No. 7,654,768.

(51) Int. Cl.
*E01F 13/00* (2006.01)

(52) U.S. Cl. ..... 404/6

(58) Field of Classification Search ..... 52/79.13, 52/600, 604, 606, 745.05, 833; 404/6, 73; 256/13.1

See application file for complete search history.

(56) References Cited

U.S. PATENT DOCUMENTS

| | | | | |
|---|---|---|---|---|
| 817,282 | A | 4/1906 | Stewart | |
| 4,598,508 | A * | 7/1986 | Baum | 52/106 |
| 4,605,336 | A | 8/1986 | Slaw, Sr. | |
| 4,828,425 | A | 5/1989 | Duckett | |
| 4,844,652 | A | 7/1989 | Schroughan | |
| 5,046,884 | A | 9/1991 | Girotti | |
| 5,149,224 | A | 9/1992 | Smith | |
| 5,156,485 | A | 10/1992 | Ivey et al. | |
| 5,286,136 | A | 2/1994 | Mandish et al. | |
| 5,605,413 | A | 2/1997 | Brown | |
| 5,860,762 | A | 1/1999 | Nelson | |
| 6,474,904 | B1 | 11/2002 | Duckett et al. | |
| 6,679,649 | B1 | 1/2004 | Capolupo | |
| 6,767,158 | B1 | 7/2004 | Consolazio et al. | |
| 7,144,186 | B1 | 12/2006 | Nolte | |
| 7,144,187 | B1 | 12/2006 | Nolte et al. | |
| 7,654,768 | B1 * | 2/2010 | Tullis et al. | 404/6 |
| 2002/0067951 | A1 | 6/2002 | Paterson | |

OTHER PUBLICATIONS

Pending U.S. Appl. No. 11/551,155 filed Oct. 19, 2006 and titled, "Massive Security Barriers Having Tie-Bars in Tunnels" by Barclay J. Tullis, Roger Allen Nolte, and Charles Merrill.

Pending U.S. Appl. No. 12/618,699 filed Nov. 13, 2009 and titled, "Method of Protection With Massive Security Barriers Having Tie-Bars in Tunnels" by Barclay J. Tullis, Roger Allen Nolte, and Charles Merrill.

* cited by examiner

*Primary Examiner* — Gary S Hartmann
(74) *Attorney, Agent, or Firm* — Barclay J. Tullis

(57) ABSTRACT

Barrier elements provide security from terrorist threats by ability to withstand both vehicle collisions and explosive blasts. Each barrier element is prefabricated to include a massive block of durable material, in some embodiments segmented, with at least one tunnel extending at least partially between respective cavities in two opposite sides of the block. Each barrier element also includes at least one beam that is preferably made of steel and extends through one such tunnel. Multiple blocks are positionable slidably on top of the ground side-against-side with their beams coupled longitudinally to one another at least approximately end-to-end. Retainer means can be used to block coupling means from entry into the tunnels. Forces from a vehicle collision or an explosive blast can cause barrier elements to rotate relative to one-another when the couplings between beams hinge or bend as the durable material that interferes with the rotation breaks away.

20 Claims, 8 Drawing Sheets

SEGMENTED MASSIVE SECURITY BARRIERS HAVING TIE-BARS IN TUNNELS

CROSS-REFERENCE TO RELATED APPLICATIONS

This application is a co-owned divisional application of parent application Ser. No. 11/551,155, titled "Massive Security Barriers Having Tie-Bars in Tunnels" and filed Oct. 19, 2006. This divisional patent application also relates to the simultaneously-filed co-pending and co-owned divisional patent application titled "Method of Protection with Massive Security Barriers Having Tie-Bars in Tunnels" having application Ser. No. 12/618,699, the disclosure of which is incorporated herein by reference in its entirety.

STATEMENT REGARDING FEDERALLY SPONSORED RESEARCH OR DEVELOPMENT

Not Applicable

THE NAMES OF THE PARTIES TO A JOINT RESEARCH AGREEMENT

Not Applicable

INCORPORATION-BY-REFERENCE OF MATERIAL SUBMITTED ON A COMPACT DISC

Not Applicable

BACKGROUND OF THE INVENTION

1. Field of the Invention

This invention relates to passive barriers located on the ground and interconnected to establish a longitudinal wall that can provide security from terrorist threats by at least slowing, and preferably stopping in a short distance, a vehicle that collides with it, and by providing at least partial protection against blast wave forces, thermal energy, and flying debris from a nearby explosion event.

2. Description of the Related Art

Security zones for protecting sensitive groups of people and facilities be they private, public, diplomatic, military, or other, can be dangerous environments for people and property if threatened by acts of terrorism. Ground anchored active anti-ram vehicle barriers, bollards, and steel gates may stop a vehicle but may do little against a blast wave or blast debris. Earthen berms, sand-filled steel walls, massive concrete or plate steel walls anchored into the ground, or concrete panels laminated with steel sheeting and anchored into the ground have been used to shield against both terrorist vehicles and bombs. But none of these ground-anchored barriers are portable for ease of relocation, and all risk the possibility of interfering with underground utilities and other underground hazards.

However, both U.S. Pat. No. 7,144,186 to Roger Allen Nolte titled "Massive Security Barrier" and U.S. Pat. No. 7,144,187 to Roger Allen Nolte and Barclay J. Tullis titled "Cabled Massive Security Barrier", both incorporated herein by reference in their entireties, disclose barriers that are portable for ease of relocation and do not endanger underground utilities when being deployed, installed, or removed. U.S. Pat. No. 7,144,186 discloses barriers, each with at least one rectangular tie-bar of steel cast permanently within concrete or other solid material and extending longitudinally between opposite sides of the barrier, wherein adjacent barriers are coupled side-against-side by means of strong coupling devices between adjacent tie-bars, and wherein no ground penetrating anchoring means is involved. But since the tie-bars are cast within the barriers, they cannot be changed out or upgraded without removing and replacing the solid material as well. U.S. Pat. No. 7,144,187 discloses barriers of solid material with tunnels extending between opposite sides, wherein adjacent barriers are coupled side-against-side with cables passing through the tunnels and anchored to sides of at least some of the barriers by anchoring devices. But since cables through tunnels between adjacent barriers are less able to resist lateral displacement between adjacent barriers compared to that when using rigidly coupled tie-bars, the use of cables limits the relative shortness of stopping distance that a wall can achieve, where stopping distance is the maximum distance any portion of a wall moves before all the kinetic energy causing an external force is absorbed.

U.S. Pat. No. 6,474,904 to Duckett et al. titled "Traffic Barrier with Liquid Filled Modules", although not in the field of massive security barriers for protection against terrorist threats, discloses a traffic barrier design that uses a attachment members (similar in some respects to a tie-bar) through a tunnel within a cavity shaped by a plastic shell of a module body for containing water or other fluid. Duckett et al. also uses abutment members to constrain longitudinal positions of tie-bars relative to module bodies, but not relative lateral positions. However, Duckett et al. does not disclose or suggest the use of a massive block of solid material, the coupling of massive blocks side-against-side, the enablement of mutual rotation between adjacent blocks caused by a colliding vehicle or explosive blast sufficiently strong as to cause breakage of portions of the blocks that interfere with such rotation while at the same time maintaining continuity of and between coupled tie-bars, or the use of tunnels with entrance sizes closely matched to tie-bar sizes to constrain the positions of coupled ends of tie-bars relative to barrier blocks. And Duckett et al. doesn't disclose or suggest the use of side cavities to protect or constrain coupling devices and/or their retainers.

What is needed is a massive-security-barrier wall system made of massive security barriers that can be coupled into a row along the ground or other supporting surface, wherein each barrier has at least one strong tie-bar passing through it from one side of the mass of solid material of the barrier to its opposite side, wherein adjacent barriers are interconnected side-against-side by coupling the tie-bars between those adjacent barriers, wherein the tie-bar(s) of each barrier are constrained longitudinally and horizontally by the mass of solid material of that barrier to resist lateral displacement between adjacent barriers, and wherein the tie-bars can be selected at the time barriers are assembled into a barrier wall. What is needed also is the capability of exchanging or upgrading tie-bars in the field without having to replace the masses of solid material, and without the additional cost of scrapping that material. In other words, what is needed is a massive security barrier system that uses tie-bars through masses of solid material without having the tie-bars cast into the masses of solid material. The current invention provides such a system with such barriers.

BRIEF SUMMARY OF THE INVENTION

The invention is pointed out with particularity in the appended claims. However, some aspects of the invention are summarized herein.

The invention includes a massive security barrier module, a security wall, and a method of providing security from a terrorist threat, the method by the assembly of massive security barriers to form a security wall. The invention improves over the prior art by combining into a massive security barrier at least one tie-bar through at least one tunnel, wherein the tunnel penetrates through the mass of solid material (also called a block or barrier block) of the barrier. The invention uses coupling devices, and retainer devices as well in some embodiments, to both retain a tie-bar to a barrier block and to couple barrier blocks together side-against-side. A security wall is constructed by coupling or otherwise linking two or more such massive security barriers side-against-side to form a longitudinal wall that can provide security from terrorist threats by being able to withstand both vehicle collisions and explosive blasts that can provide sufficient external force to a) cause at least a portion of such a wall to slide across the ground or other supporting surface and b) if sufficient force is applied to break away interfering material, to cause at least some adjacent barriers to rotate relative to one another and not become uncoupled from one another. Each massive security barrier includes a mass of solid material having a slidable bottom surface, two opposite side surfaces each with at least one cavity, one or more tunnel passages extending through the mass of solid material between its opposite sides, and one or more tie-bars (also called metal beams) each having two opposite ends spaced longitudinally apart positioned in at least one of the tunnels with the two opposite ends extending respectively outward into two of the cavities. The mass of solid material is of durable material and preferably of high strength concrete. Each tie-bar is preferably made of high strength steel and typically has a cross-sectional area greater than that of an ordinary rebar rod used to reinforce concrete structures. Multiple blocks as described can be positioned on top of the ground, road-surface, parking surface, or other supporting surfaces, and coupled longitudinally to one another, with tie-bars end-to-end, and with adjacent barrier blocks side-against-side to establish a protective barrier wall. Within this disclosure, the term "end-to-end" should be taken to mean any of the following: truly end-to-end, butt-end-to-butt-end, generally end-to-end, end-overlapping-end, having interleaved ends, approximately end-to-end, or any other equivalent structural relationship that permits two tie-bars to be joined together near one each of their ends, extends their overall combined length, and provides a combined structure that will support tension and compression forces longitudinally and shear forces laterally. The coupling devices that serve as means for coupling can be, or (in some embodiments) retainer devices (also called retainers) that function as means for retaining are, sized relative to the sizes of tunnel entrances to block the coupling devices from entering the tunnels, i.e. they can prevent longitudinal translation of tie-bars within a barrier. Either or both a) the sizes of coupling devices (and separate retainer devices when used) relative to the sizes of the cavities or b) the sizes of the cross-sections of the tie-bars relative to the entrances of the tunnels, horizontally constrain lateral translation at locations within the blocks. Such a wall can withstand great longitudinal tension and can absorb and endure great amounts of mechanical and thermal energy. When loaded laterally (and horizontally), such as by forces from a nearby explosive blast or by a collision from a moving vehicle, such a wall can act at least initially as a structural beam, with at least one chain of tie-bars in tension, and with the solid material (e.g. concrete) in compression on the side of the wall facing the blast or vehicle. With sufficient tensile strength in a chain of tie-bars as the wall changes its shape by moving over the ground, vertical edges of the solid material (i.e. front or rear portions of the sides of blocks) in compression can be designed to fail by absorbing significant energy, and as a result, adjacent barriers can rotate or hinge relative to one-another as their inter-coupling devices swivel or the tie-bars near the couplings bend.

One of the embodiments of the invention is a method for providing protection from a terrorist threat, the method comprising: a) aligning multiple barriers into a row between an expected safe side and a threat side, wherein each barrier is aligned side-against-side with another of the multiple barriers to form an adjacent pair respectively; and b) using means for coupling and means for retaining to couple and retain each adjacent pair in the row; wherein the row extends longitudinally from a first barrier to a second barrier; wherein each of the barriers comprises a mass of solid material and a tie-bar; wherein each mass of solid material comprises two opposite sides, two cavities with one in each of the two opposite sides, and a tunnel through the mass of solid material between the two cavities; and wherein each of the barriers further comprises a tie-bar that extends through the tunnel of that barrier and has two end-portions each of which penetrates at least a portion of one of the two cavities of that barrier; whereby at least all excepting the first and second barriers of the row have sufficient strength to remain coupled throughout a terrorist event that is one selected from the group consisting of a colliding terrorist's vehicle and a terrorist's explosive blast; and whereby forces from the terrorist event can be strong enough to cause at least some of the coupled barriers to slide across a supporting surface, and can cause breakage of solid material where the solid material interferes with rotation between adjacent barriers. The method can further comprise using means for coupling and means for retaining, to retain each of the first and second barriers. The general shape of a lateral cross-section of a tunnel can be any shape that will accommodate a tie-bar, e.g. circular, elliptical, oval, square, rectangular, polygonal, multi-sided, and irregular. A tunnel should be large enough that a tie-bar extending though it can be at least wiggled to adjust its position relative to a tie-bar of an adjacent barrier with which it is to be coupled. At least one instance of the means for retaining can be located between an instance of the means for coupling and one of the tunnels. And an instance of means for coupling can itself serve also as an instance of means for retaining.

According to one aspect of the above embodiment, at least one instance of means for coupling can be comprised of a pin or a bolt, wherein at least two of the end portions coupled by the means for coupling each includes a hole that receives the pin or bolt. And at least one tie-bar can have a laterally larger cross-sectional area in at least one of its end portions than along its mid-portion, and wherein at least one instance of means for coupling comprises an enclosure that laterally encircles that end portion and obstructs it from being pulled out of the enclosure.

Another embodiment of the invention is a security wall comprising: a) a row of coupled barriers, each barrier comprising respectively: i) a mass of solid material that comprises two opposite sides, two cavities with one in each of the two opposite sides, and a tunnel through the mass of solid material between the two cavities, and ii) a tie-bar that extends through the tunnel and has two end-portions each of which penetrates at least a portion of a respective one of the two cavities; wherein each barrier is aligned side-against-side with another of the multiple barriers to form an adjacent pair; and b) for each adjacent pair an instance of means for coupling the tie-bar of one of the barriers of that adjacent pair to the tie-bar of the other barrier of that adjacent pair, and for each adjacent pair at least one instance of means for retaining in one of the cavities between the barriers of that adjacent pair for retaining the instance of means for coupling from entry into the tunnel that opens into said one of the cavities; whereby the coupled barriers have sufficient strength to remain coupled throughout a terrorist event that is one selected from the group consisting of a colliding terrorist's vehicle and a terrorist's explosive blast; and whereby forces from the terrorist event can be strong enough to cause at least some of the coupled barriers to slide across a supporting surface, and can cause breakage of solid material where the solid material interferes with rotation between adjacent barriers. The security wall can be further comprised of: a) at least two additional instances of means for coupling; and b) at least two additional instances of means for retaining; wherein the two additional instances of means for coupling and the two additional instances of means for retaining are installed at ends of the row. The general shape of a lateral cross-section of at least a portion of at least one of the tunnels can be at least approximately one selected from the group consisting of circular, elliptical, oval, square, rectangular, polygonal, multi-sided, and irregular; and wherein the cross-sectional area of that tunnel can be large enough that of the tie-bar extending through that tunnel can be wiggled within that tunnel. A tunnel should be large enough that a tie-bar extending though it can be at least wiggled to adjust its position relative to a tie-bar of an adjacent barrier with which it is to be coupled. At least one of the instances of means for retaining can be located between one of the instances of means for coupling and one of the tunnels. And at least one of the instances of means for coupling can comprise one of the instances of means for retaining.

According to one aspect of the above embodiment, at least one of the instances of means for coupling can be comprised of a pin or a bolt, and wherein at least two of the end portions coupled by the element each includes a hole that receives the pin or bolt. And at least one tie-bar can have a laterally larger cross-sectional area in at least one of its end portions than along its mid-portion, and wherein at least one instance of means for coupling comprises an enclosure that laterally encircles that end portion and obstructs it from being pulled out of the enclosure.

Another embodiment of the invention is a massive security barrier module comprising: a) a mass of solid material having a slidable bottom surface, wherein the mass has two opposite sides, a front, and a back, wherein each side has a front edge near the front, wherein each side has a back edge near the back, wherein each of the two opposite sides each contains one of a pair of opposite cavities, and wherein at least one tunnel extends between the pair of opposite cavities and through the mass; b) at least one tie-bar extending through the tunnel and into the cavities; c) means for coupling the tie-bar to other tie-bars of similar and adjacent massive security barrier modules, the adjacent massive security barrier modules being side-against-side with said massive security barrier module, and the other tie-bars retained at sides that are remote from the sides of said massive security barrier module; and d) means for retaining the means for coupling from entry into the tunnel; whereby the massive security barrier module has sufficient strength to maintain attachment with the adjacent massive security barrier modules when said massive security barrier module is subjected to an external impulsive force from a terrorist act sufficiently strong to rotate the modules relative to one another and cause at least one of the edges that structurally interferes with that rotation to break; and whereby energy from a security-threat event is absorbed by the break and further attenuated by the bottom surface of said massive security barrier module sliding across a supporting surface. And at least one instance of the means for coupling can comprise an instance of the means for retaining. At least one instance of the means for coupling can be comprised of a pin, a bolt, or an enclosure. Another embodiment of the invention is similar to the massive security barrier module described above in this paragraph, except that said mass of solid material is comprised of at least two individual segments that key into one another, and only one of which includes the tunnel for the tie-bar, wherein the tie-bar can be cast within the other of the two segments without requiring a tunnel; whereby the segments of the module can be handled and shipped independently.

OBJECTS AND ADVANTAGES OF THE INVENTION

Objects and advantages of the present invention include a security barrier that is massive, durable to vehicle collisions, durable to explosive blasts, energy absorbing, portable, inexpensive to manufacture, inexpensive to deploy, inexpensive to upgrade or downgrade with changes in tie-bars, inexpensive to relocate, inexpensive to remove, able to be firmly coupled to adjacent barriers, able to transfer rotational forces to adjacent barriers, able to transfer longitudinal tension forces to adjacent barriers, able to transfer compressive forces to adjacent barriers, resistant to rolling, resistant to sliding, has a high coefficient of friction with the ground (or other supporting surface), available in a variety of architectural designs and surface appearances, providing of mounting fixtures for flags and cameras and the like, providing of chases or conduits for utilities, and non threatening to utilities located below the ground.

The same objects and advantages of the invention that apply to a single barrier extend to barrier walls constructed by coupling adjacent barriers to one another in a longitudinal side-against-side row of barriers. Parts of the invention and its preferred embodiments include means for coupling tie-bars end-to-end.

The barriers can be transported by truck, positioned at a security site by using readily available heavy lifting equipment, and can be longitudinally inter-connected by means of field-installable mechanical coupling hardware. The invention does not require ground-penetrating anchoring devices, so installation, relocation, and later removal does not endanger underground utilities. And since the tie-bars are not cast into concrete or other solid material of the barriers, but rather are positioned in at least slightly larger tunnels within the concrete or other solid material of the barriers, the tie-bars can be wiggled within the tunnels to better enable alignment with adjacent tie-bars of neighboring barriers, can be selected at the time of installation for strength capability, and can be repaired, upgraded, or otherwise replaced in the field without having to scrap any mass of solid material. Another advantage of the invention is that cables can optionally also be passed through the tunnels to be used as a secondary strength system in case a tie-bar fails, and this would permit such a wall to be pushed still farther from its initial position but remain a connected barrier.

Further advantages of the present invention will become apparent to the ones skilled in the art upon examination of the drawings and detailed description. It is intended that any additional advantages be incorporated herein.

The various features of the present invention and its preferred implementations may be better understood by referring to the following discussion and the accompanying drawings. The contents of the following discussion and the drawings are set forth as examples only and should not be understood to represent limitations upon the scope of the present invention.

BRIEF DESCRIPTION OF THE SEVERAL VIEWS OF THE DRAWINGS

The foregoing objects and advantages of the present invention for a massive security barrier and security wall of such barriers (and its method of assembly) may be more readily understood by one skilled in the art with reference being had to the following detailed description of several embodiments thereof, taken in conjunction with the accompanying drawings. Within these drawings, callouts using like reference numerals refer to like elements in the several figures (also called views), alphabetic-letter-suffixes where used help to identify copies of a part or feature related to a particular usage and/or relative location, a single prime can denote a part or feature at an opposite location relative to an un-primed part or feature respectively, a numeric suffix following an alphabetic-letter-suffix denotes a modification to a part, and a double (or more) prime as an only suffix also denotes a modification to a part. Within these drawings.

DETAILED DESCRIPTION OF THE INVENTION

Figure 1:
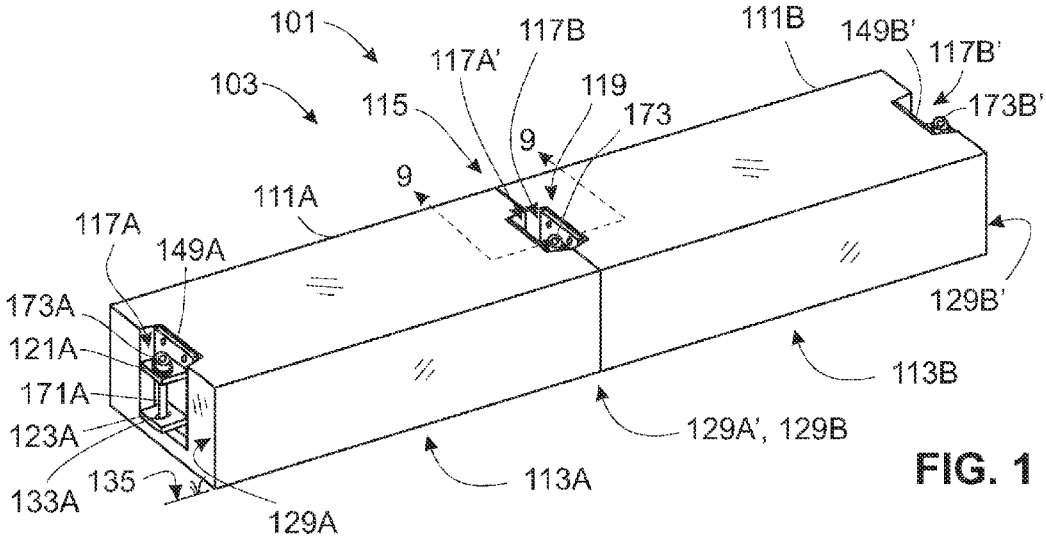
FIG. 1 shows a perspective view of two massive security barriers, one on the left and the other on the right in the view, coupled together side-against-side to form a short massive security wall.

The following is a detailed description of the invention and its preferred embodiments as illustrated in the drawings. While the invention will be described in connection with these drawings, there is no intent to limit it to the embodiment or embodiments disclosed. On the contrary, the intent is to cover all alternatives, modifications and equivalents included within the spirit and scope of the invention as defined by the appended claims.

FIG. 1 shows a perspective view of one embodiment of the invention, that being two massive security barriers 113A and 113B adjacent to one another, the massive security barrier 113A on the left and the massive security barrier 113B on the right in the view, coupled together side-against-side into a coupled pair of massive security barriers 101 to form a short security wall 103. (Two massive security barriers adjacent to one another are referred to herein as an adjacent pair, independent of whether they are coupled or not.) The barriers 113A and 113B are sitting on top of a supporting surface such as a ground surface 135. One skilled in the art should appreciate that such a supporting surface could be, for example, the ground surface of a lawn, the surface of an open field, the surface of a parking lot, the surface of a roadway, the surface of a shoulder of a roadway, the surface of a plaza, etc. In this embodiment, the massive security barrier 113A is comprised of a mass of solid material 111A and two tie-bars (161A and 163A called out in the cross-sectional view of FIG. 9) whose left-hand ends 121A and 123A are visible in this view. Also, the massive security barrier 113B is comprised of a mass of solid material 111B and two tie-bars (161B and 163B called out in the cross-sectional view of FIG. 9). It should be appreciated by one skilled in the art that other embodiments of the invention could be comprised of only one tie-bar per barrier, or more than two tie-bars per barrier. It should also be appreciated by one skilled in the art that other embodiments of a security wall by the invention can be comprised of a row of multiple barriers preferably numbering greater than merely the two illustrated.

In regard to FIG. 1, the mass of solid material 111A has two opposite sides 129A and 129A', and the mass of solid material 111B has two opposite sides 129B and 129B'. The two masses of solid material 111A and 111B are shown adjacent to one another with sides 129A' and 129B against one another (i.e. at least nearly touching one another) thereby defining an interface region 115. Within each side of each barrier is a cavity into which the one or more tie-bars associated with that barrier penetrate. The mass of solid material 111A of barrier 113A has cavities 117A and 117A'. The mass of solid material 111B of barrier 113B has cavities 117B and 117B'. Tie-bar ends 121A and 123A are visible in this view extending into cavity 117A at the far left of the view. In cavity 117A at the left end of the security wall 103, a coupling pin 171A is visible along with its head 173A. The coupling pin 171A extends through both tie-bar ends 121A and 123A, through holes 131A (not visible in this view, but visible in FIGS. 5, 6, and 12) in the upper tie-bar 121A and 133A in the lower tie-bar 123A.

In regard to FIG. 1, holes such as hole 133A are in both ends of each tie-bar and are oval shaped with extension parallel to the length-wise dimension of its corresponding tie-bar. Such extensions can accommodate deviations in the accuracy of the placement of the holes when inserting a coupling pin (such as coupling pin shown with head 173 in this view between the two barriers 113A and 113B) during installation of a security wall (such as 103). These oval shaped holes are also used to alleviate tension between coupled tie-bars during the very initial interaction between coupled barriers when a security wall of which the barriers are apart is first struck by a moving vehicle, a period in time during which the security wall begins to change shape as barriers begin to slide across the supporting surface 135 and as some of the masses of solid material that interfere with mutual rotation of adjacent barriers begins to break away.

In regard to FIG. 1, also visible is a retainer 149A that both tie-bars with ends 121A and 123A extend through. In cavity 117B' at the right end of the security wall 103, the head 173B' is visible of coupling pin 171B' (the body of pin 171B' is not visible in this view) along with a retainer 149B', both in a similar arrangement as the coupling pin 171A and retainer 149A shown at the left end of the security wall 103, only attached to the tie-bars of barrier 113B instead. Within the interface region 115, the cavity 117A' of barrier 113A and the cavity 117B of barrier 113B together form a combined cavity 119 between these adjacent barriers 113A and 113B. Within this combined cavity 119, the head 173 of a coupling pin 171 (pin 173 is not visible or labeled in this view but is visible and labeled in the sectional view of FIG. 9) and two retainers (not labeled in this view but labeled in the sectional view of FIG. 9 as 149A' and 149B) are visible. Note that the head 173 of coupling pin 171, and the coupling pin 171 itself (the pin coupling the two barriers 113A and 113B together in the interface region 115 and visible in FIG. 9), could each alternatively be labeled with a suffix of A' or B because they can be considered as either the coupling pin at the right-hand side of the left barrier or the coupling pin at the left-hand side of the right barrier. It will be readily appreciated by one skilled in the art that after completion of installation of a security wall such as 103, it is advisable to protect the otherwise exposed tie-bar ends and means for coupling (and means for retaining if used) with protective covers and/or sealing means to conceal the presence of the cavities, discourage tampering, and keep out rain and snow.

Figure 2:
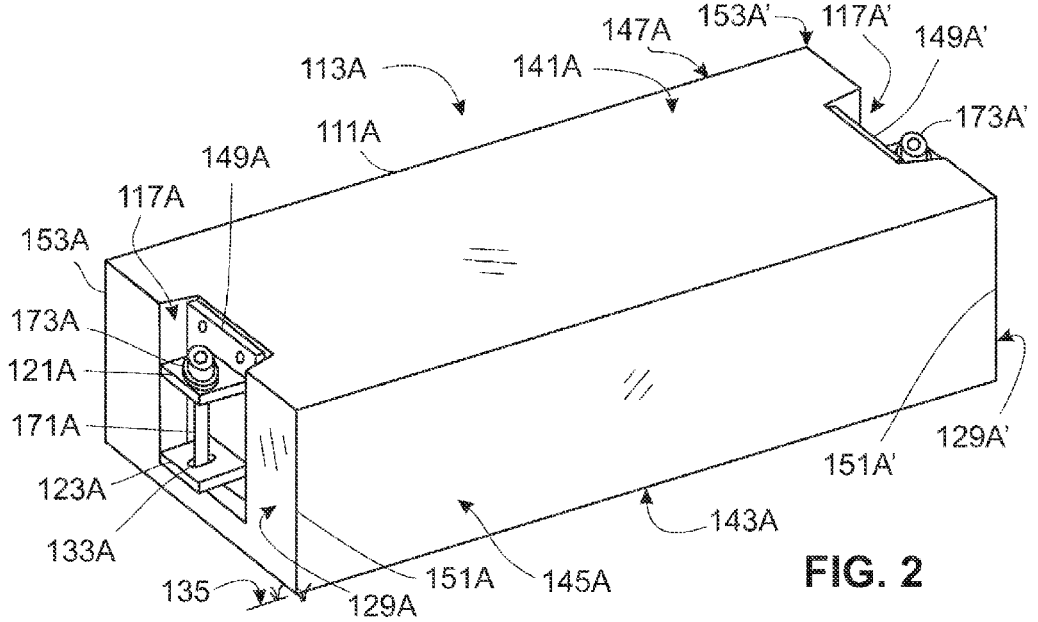
FIG. 2 shows an enlarged view of the barrier on the left from the view shown in FIG. 1.

FIG. 2 shows an enlarged perspective view of the massive security barrier 113A as it might be configured for storage, shipment, or handling before being connected to one or two other barriers. All that is shown in this view is also shown in FIG. 1 with one exception being that FIG. 2 shows callouts for a top surface 141A, a bottom surface 143A, a front surface 145A, and a back surface 147A of the mass of solid material 111A of barrier 113A. Another exception is that FIG. 2 also shows outer vertical edges 151A, 153A, 151A', and 153A' formed at the intersections of the side surfaces 117A and 117A' with the front surface 145A and the back surface 147A. Another exception is that FIG. 2 shows at the right of the view the head of a coupling pin with a callout of 173A' instead of 173 as it would be labeled if shown connecting to another barrier. And another exception is that a retainer plate 149A' is also shown at the right of the view. It will be readily appreciated by one skilled in the art that the shapes of the cavities, such as 117A and 117A', are ones which allow access to coupling devices from above, that a drain hole (not shown) is desirable near the bottom of each adjacent pair of cavities, and that there should remains ample solid material at outer vertical edges of a mass of solid material to protect what is in the cavities formed between two adjacent barriers (as cavity 119 between barriers 113A and 113B shown in FIG. 1). One skilled in the art will also readily appreciate that the assembly shown is not the only configuration in which to store, ship, or handle a barrier, and that one might choose to store, ship, or handle the various components independently.

Figure 3:
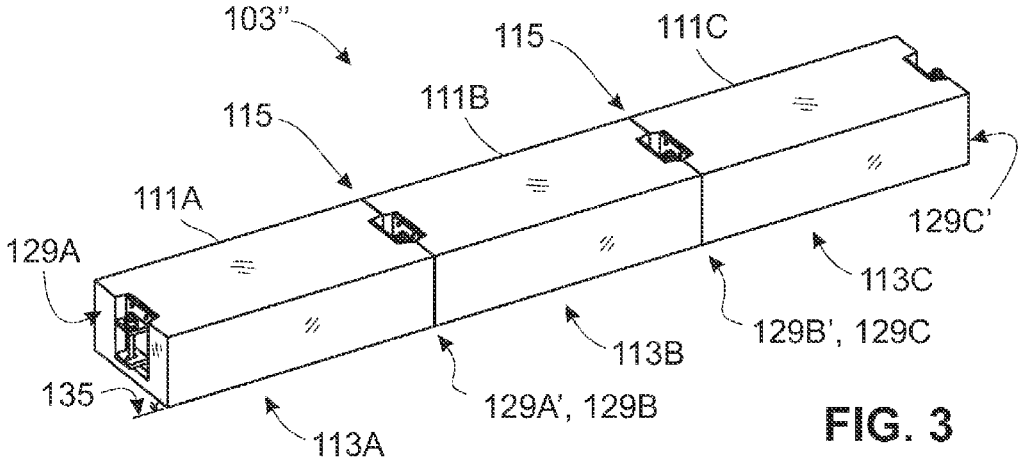
FIG. 3 shows a perspective view of three massive security barriers coupled together side-against-side to form a security wall.

FIG. 3 shows a perspective view of three massive security barriers 113A, 113B, and 113C coupled together side-against-side to form a security wall 103" that rests on a ground surface 135. Each barrier 113A, 113B, and 113C is comprised of a mass of solid material 11A, 11B, and 11C respectively. The side 129A of barrier 113A forms one end of the wall 103", and the side 129C' forms the other end of the wall 103". Between barriers 113A and 113B is an interface region 115 where the side 129A' of barrier 113A is against the side 129B of barrier 113B. Between barriers 113B and 113C is an interface region 115 where the side 129B' of barrier 113B is against the side 129C of barrier 113C. This massive security wall 103" is much like, but longer by one barrier, than the security wall 103 shown in FIG. 1. To change the wall 103 of FIG. 1 into the wall 103" of FIG. 3, the one additional barrier 113C has been provided and positioned side-against-side to barrier 103B, and an additional coupling device along with two additional retainer devices have been provided and installed.

Figure 4:
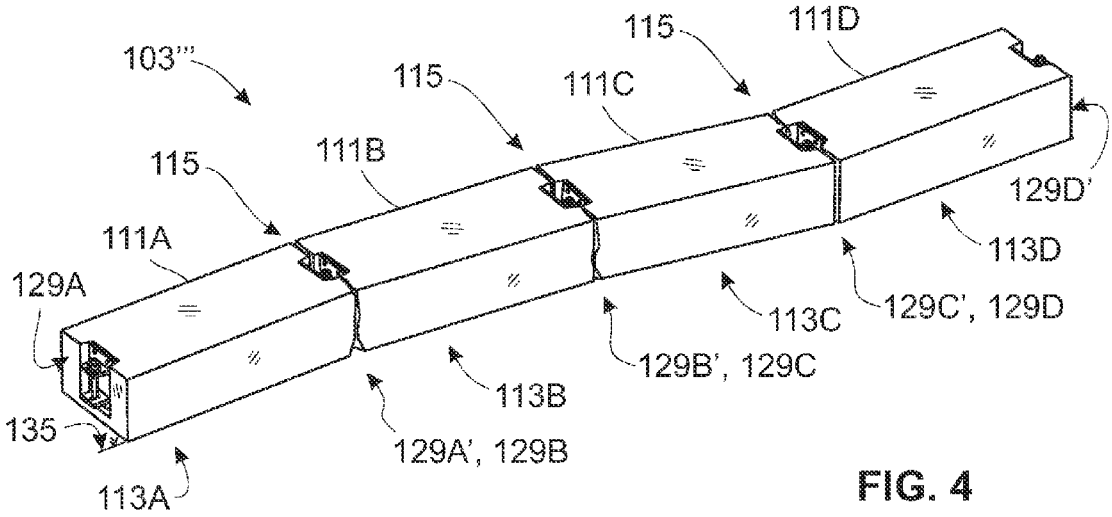
FIG. 4 shows a perspective view of four massive security barriers coupled together side-against-side to form a security wall that has some of its vertical edges damaged but remains secured together.

FIG. 4 shows a perspective view of four massive security barriers 113A, 113B, 113C, and 113D coupled together side-against-side in a row to form a security wall 103'" that has some of its vertical edges damaged but remains secured together. To change the wall 103" of FIG. 3 into the wall 103'" of FIG. 4, the one additional barrier 113D has been provided and positioned side-against-side to barrier 103C, and an additional coupling device along with two additional retainer devices have been provided and installed. The wall 103'" is shown in a non-straight line to illustrate a shape that might be caused by a terrorist vehicle having collided with the front of the wall 103'" and dragging it along the ground. It is to be noted that vertical edges have been broken by compression in the masses of solid material 111A, 111B, and 111C near the front of the wall resulting from collision-caused forces that were sufficient to cause at least some rotation between adjacent barriers 113A and 113B, between adjacent barriers 113B and 113C, and between adjacent barriers 113C and 113D. Such a pattern of rotation directions might result from a vehicle having crashed into the front of barrier 113B.

In regard to FIG. 4, one skilled in the art will appreciate that end portions of the tie-bars at the left end of the barrier 113A, and end portions of the tie-bars at the right end of the barrier 113D, of the security wall 103'" in this view, can be retained from entering tunnels within the barriers 113A and 113D by using devices designed to anchor one or more ends of tie-bars to a barrier.

Figure 5:
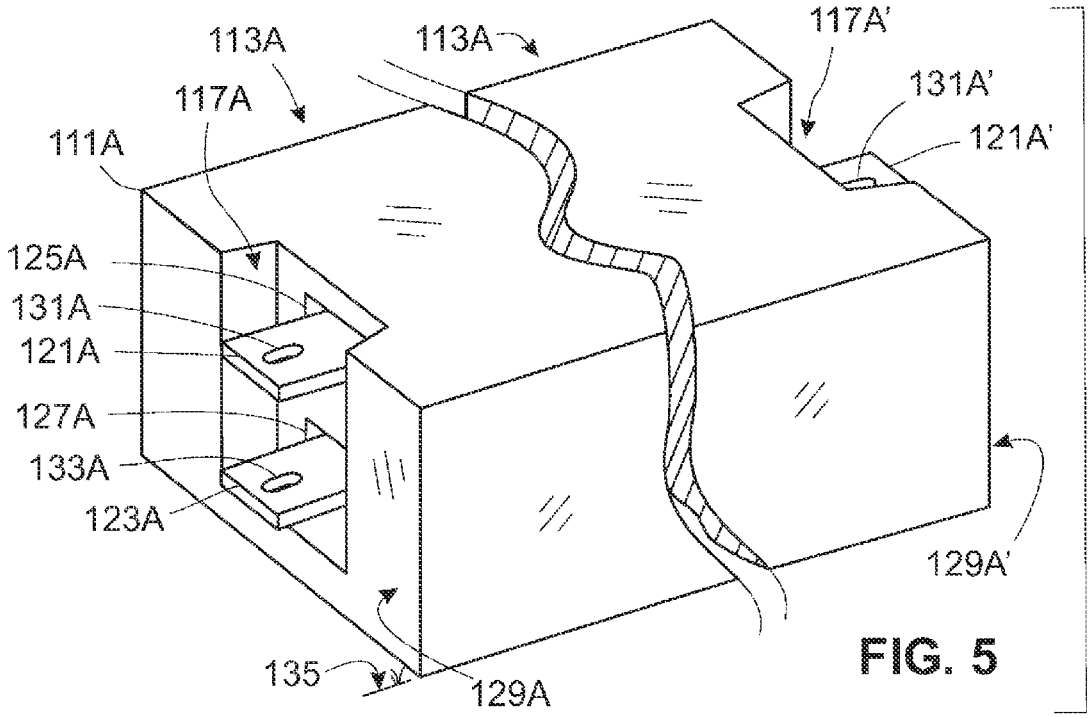
FIG. 5 shows a barrier without the presence of coupling hardware or retainer hardware, revealing tie-bars within tunnels within a block or mass of solid material.

FIG. 5 shows barrier element 113A in a view that is enlarged even further, shown with a middle portion of the barrier 113A removed in order to fit into the view both sides 129A and 129A' of the barrier 113A. In this view, coupling pins and retainers are not present as they are in FIG. 2, thus revealing in FIG. 5 that the mass of solid material 111A includes a first tunnel 125A and a second tunnel 127A. Tunnels 125A and 127A are located in this embodiment with one over the other, the tunnel 125A being above the tunnel 127A. With one tunnel over another, a single coupling pin can be used to connect both tie-bars of one barrier to a similar pair of tie-bars in an adjacent barrier, as the coupling pin with head 173 couples barrier 113A to 113B shown in FIG. 1.

In regard to FIG. 5, the cross-sectional shapes of the tunnels 125A and 127A are shown in this implementation to be rectangular and bigger but not much bigger than the rectangular cross-sectional shapes of the tie-bars having ends 121A and 123A visible at the left-hand side of the view. One skilled in the art will readily appreciate that the cross-sectional shapes and sizes of the tunnels and tie-bars need not be constant over their lengths, but that typically they would be, and that the cross-sectional shape of a tunnel is not limited to rectangular, but could instead be square, circular, elliptical, triangular, polygonal, or even irregular.

In regard to FIG. 5, the cross-sectional shape of a tie-bar, such as that with ends 121A and 121A', is typically rectangular but can be of other shapes as is discussed below in regard to FIG. 16, and a tie-bar is typically made of high-strength steel.

In regard to FIG. 5, one skilled in the art will also readily appreciate that a barrier, such as 113A, could be made with only a single tunnel 125A and a single tie-bar as having tie-bar ends 121A and 121A', or could be made with more than a single tie-bar in any one tunnel 125A.

In regard to FIG. 5, a mass of solid material, such as 111A, which is also called a block, is typically shaped as a rectangular block but could have alternative shapes such as having beveled edges, and any of its surfaces could be other than flat. A mass of solid material, such as 111A, is typically made of high-strength concrete and would typically include an inner structure of strengthening rebar as known in the prior art. And a mass of solid material, such as 111A, can also typically include additional features such as a) hooks or loops in the top to aid manufacturers, distributors, and installers in lifting and positioning the mass of solid material, b) recesses in the bottom surface for use by fork-lifting equipment and for use in permitting the passage of water drainage, c) features to support ancillary objects such as surveillance cameras and lighting fixtures, and d) chases for routing communications and power cables or other utilities.

In regard to FIG. 5, one skilled in the art will readily appreciate that a tunnel can be made into a mass of solid material (concrete for example) most conveniently by casting the material using a casting form that can accept and position a tube, whereby the tube defines the tunnel and can remain with the finished block when the block is removed from the form, the tube thus becoming a permanent part of the cast block. Alternatively, the tube can be coated at least on the outside with a release agent so that the tube can eventually be removed from the block. Also, alternatively, a tunnel can be defined by casting into the block a roll of bubble-wrapping material that can later be removed, or a tie-bar can be wrapped with bubble-wrapping material and then cast into place after which the bubble-wrapping material can be broken down with hot gas, a hot poker, or other tools.

Figure 6:
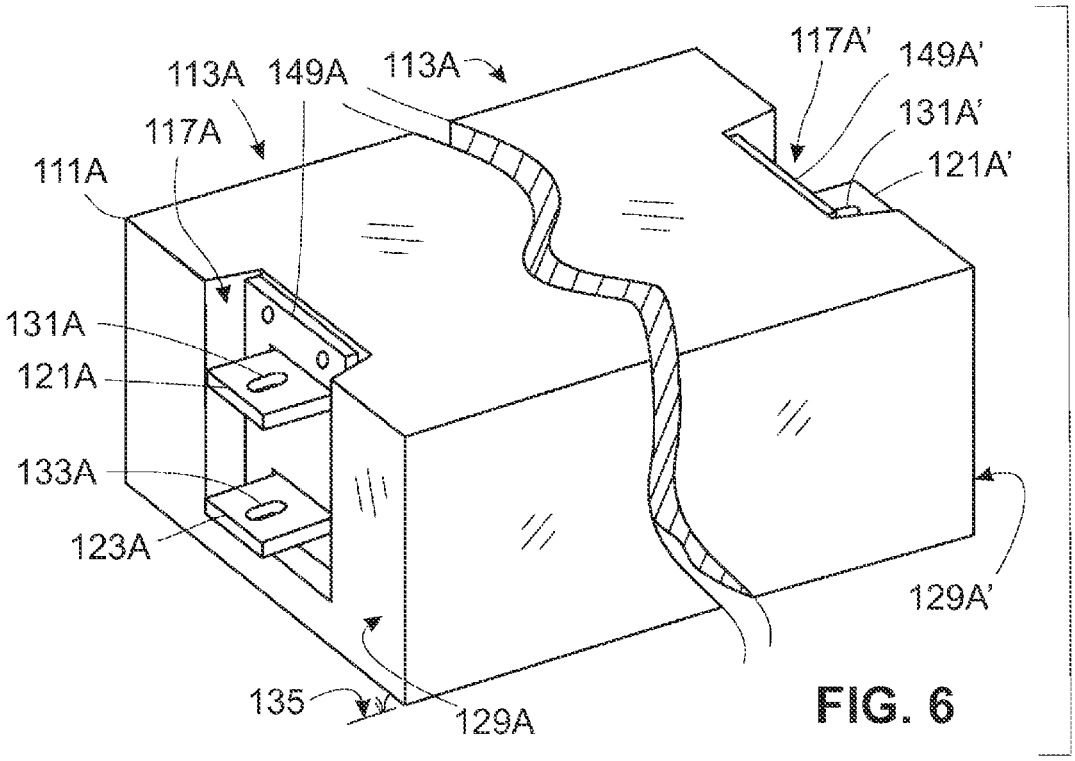
FIG. 6 shows a barrier with the presence of retainer hardware but without the presence of coupling hardware.

FIG. 6 is similar to FIG. 5 and shows the barrier 113A with the presence of retainers 149A and 149A' but without the presence of coupling hardware. It can be readily appreciated that retainers 149A and 149A' block entrances to the tunnels which they hide in this view. One of the purposes of using retainers such as these (they are sometimes optional) is that they can help to prevent the ends of tie-bars from being pulled into the entrances of the tunnels under applied applied tension to the tie-bars and given coupling devices that might otherwise deform sufficiently to be pulled into the tunnels along with ends of the tie-bars. When there are two tie-bars positioned along side of one another as illustrated in this embodiment, it is convenient to share one retainer at each of the barrier with both tie-bars, although this too is optional.

Figure 7:
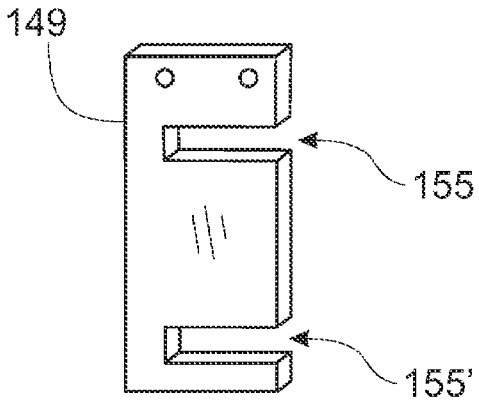
FIG. 7 shows a first example of means for retaining that is a retainer which can be used to prevent one or two coupling devices near the ends of two tie-bars in a common barrier block from entering either of two tunnels in the barrier.

FIG. 7 shows a first example of a retainer 149 (means for retaining) which can be used to prevent one or two coupling devices near the ends of two tie-bars in a common barrier from entering either of two tunnels in the barrier. In the upper portion of the retainer 149 is a slotted hole 155 for location partly around an upper tie-bar, and a slotted hole 155' for location partly around a lower tie-bar. An advantage of using a retainer with slotted holes instead of holes without slots is that such a retainer can be put into place about two tie-bars, before the coupling device is put into place. This can be done by lowering the retainer into a cavity alongside the tie-bars, such as cavity 119 shown in FIG. 1 if the cavity 119 is deep enough horizontally into the sides of the blocks, and then rotating the retainer in such a manner that the tie-bar ends move into the slots of the slotted holes.

Figure 8:
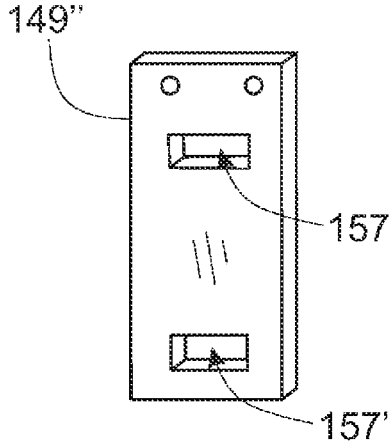
FIG. 8 shows a second example of means for retaining that is a retainer which can be used to prevent one or two coupling devices near the ends of two tie-bars in a common barrier from entering either of two tunnels in the barrier.

FIG. 8 shows a second example of a retainer 149" (means for retaining) which can be used to prevent one or two coupling devices near the ends of two tie-bars in a common barrier from entering either of two tunnels in the barrier. In this embodiment, however, there are no slots but only holes 157 and 157'. In this case, the installation of retainers can be accomplished for example by either a) positioning a first barrier block against a second barrier block and locating any desired retainers 149" before slipping the last tie-bars for those two blocks into place, or b) slipping the retainer 149" over two tie-bars already positioned within a barrier block and then positioning that block next to what becomes its adjacent neighbor to form an adjacent pair of blocks. And of course retainers of the type as 149 in FIG. 7 can also be installed in these ways.

In regard to FIGS. 7 and 8, the shapes of retainers 149 and 149" can be other than the rectangular shapes illustrated, the optimum shape being dependent upon the size and shape of any tunnel entrances they are designed to block, and depending upon the size(s) of the cavities within which they are situated in the sides of the barrier blocks.

Figure 9:
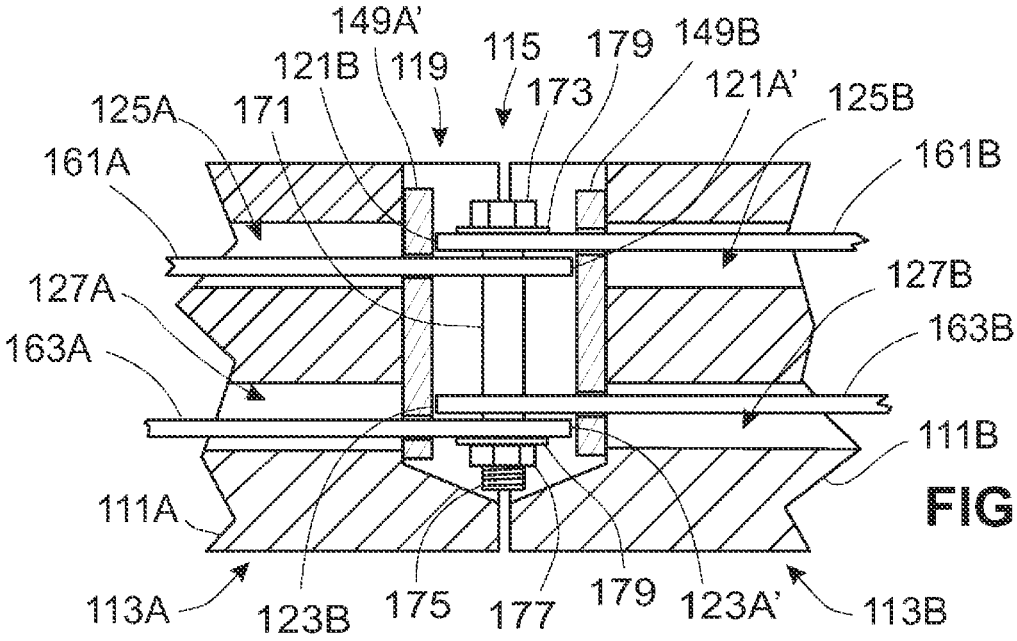
FIG. 9 is a sectional view from FIG. 1 showing means for coupling and means for retaining, wherein a coupling device and two retainers are used to couple the two barriers together sides-against-side with the tie-bars of one barrier positioned end-to-end respectively with the tie-bars of the other barrier.

FIG. 9 is a sectional view from FIG. 1 showing the coupling pin 171 (means for coupling) with its head 173 used to couple the two barriers 113A and 113B together sides-against-side with the tie-bars 161A and 163A of one barrier positioned end-to-end respectively with the tie-bars 161B and 163B of the other barrier. Also shown are the two retainers 149A' and 149B (both are means for retaining) located to either side of the coupling pin 171. In this cross-sectional view, note that the cross-section from FIG. 1 is taken from a position nearer the front surface 145A (seen in FIG. 2) than the back surface 147A (seen in FIG. 2). The position of the cross-section is such as not to cut into the coupling pin 171 or head 173 or either tie-bar 161A or 163A, but does cut into the retainers 149A' and 149B and the masses of solid material 111A and 111B and their tunnels 125A, 127A, 125B and 127B. In this embodiment, the coupling pin 171 is shown with a threaded end 175 and fastened into place with washers 179 and a nut 177. One skilled in the art will readily appreciate that the relative vertical positioning of the upper tie-bars 161A and 161B relative to one another, and the relative vertical positioning of the lower tie-bars 163A and 163B relative to one another, can be in any of a variety of arrangements and not just that shown with the tie-bars 161B and 163B positioned above the tie-bars 161A and 163A. For example, two tie-bars of one barrier can be located between two tie-bars of an adjacent barrier.

In regard to FIG. 9, for illustrative purposes only, a small gap is shown between a side of the barrier 113A and a mutually facing side of barrier 113B, in the interface region 115; but this gap in practice should be kept as small as is practical and smaller than approximately the diameter of the illustrated coupling pin 171. Preferably the two barriers 113A and 113B would be touching one another at their mutually facing sides. The purpose of keeping the gap at the interface region 115 as small as practical is to force portions of the solid material to have to be broken away from front and/or rear surfaces (such as front and rear surfaces 145A and 147A of barrier 113A shown in FIG. 2) that include at least a portion of one of the vertical edges of one of the barriers (such as the vertical edges shown on barrier 113A in FIG. 2 as edges 151A, 153A, 151A', or 153A') before significant mutual rotation can occur between adjacent barriers (such as between barriers 113A and 113B).

In regard to FIG. 9, one skilled in the art will readily recognize that the coupling pin 171 that is shown coupling both upper tie-bars 161A and 161B together, as well as coupling both lower tie-bars 163A and 163*b* together, could be replaced with a coupling arrangement involving a pin (or one or more bolts) coupling the upper tie-bars that are separate from a pin (or one or more bolts) coupling the lower tie-bars. Another embodiment could use one coupling pin to both couple the upper tie-bars and to couple the lower tie-bars, but wherein either no threads or nut are used at the lower end of the coupling pin, or wherein threads and a nut are used just below the upper tie-bars either instead of or in addition to the threads and nut at the bottom end of the coupling pin.

Figure 10:
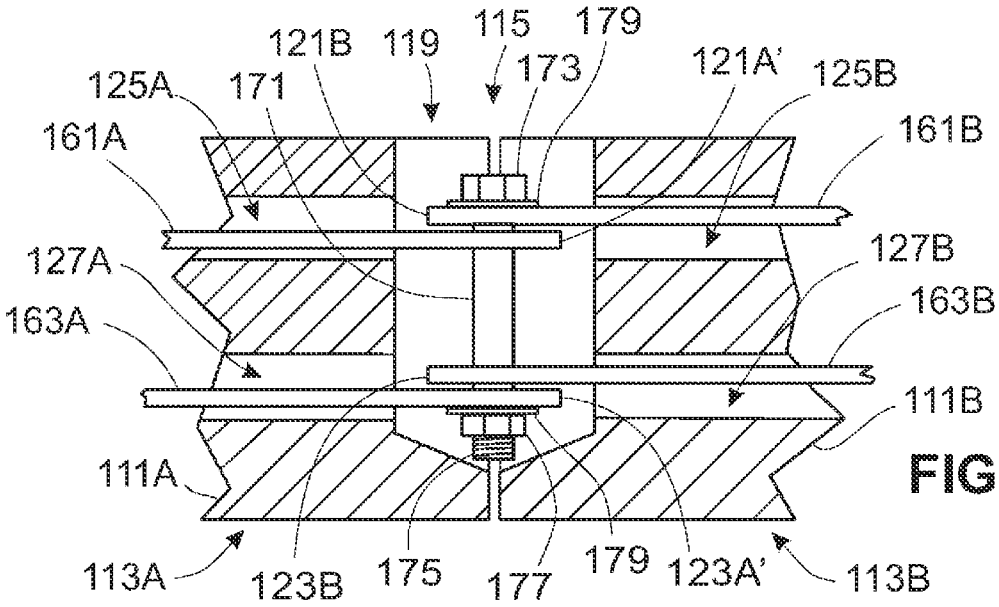
FIG. 10 is similar to FIG. 9, but wherein the two retainer devices are not being used.

FIG. 10 is similar to FIG. 9, but wherein the two retainer devices 149A' and 149B are not being used.

Figure 11:
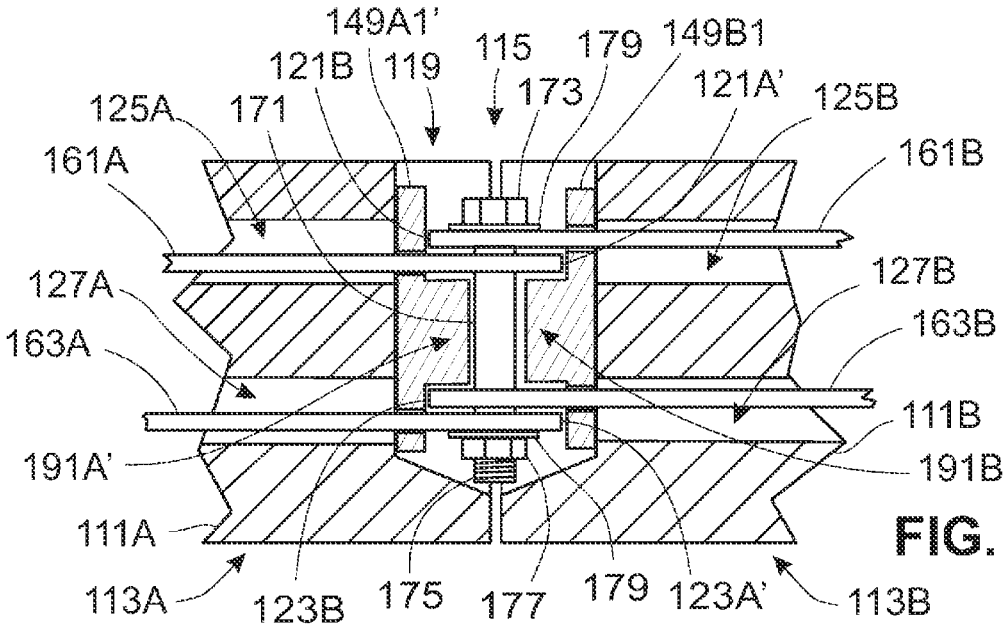
FIG. 11 is similar to FIG. 9, but wherein the two retainer devices have added features with which to fill at least some of the otherwise empty space between the coupling device and the nearest sides of the barriers.

FIG. 11 is similar to FIG. 9, but wherein the retainers 149A1' and 149B1 are of modified form compared to the retainers 149A' and 149B shown in FIG. 9. These retainers 149A1' and 149B1 have the added features 191A' and 191B respectively that fill at least some of the otherwise empty space between the coupling pin 171 and what would otherwise be the locations of the previously shown retainers 149A' and 149B respectively. In this manner, the coupling pin 171 (or some other choice of a coupling device) is afforded added protection under stress against bending or shifting its location relative to the other components shown in this view.

Figure 12:
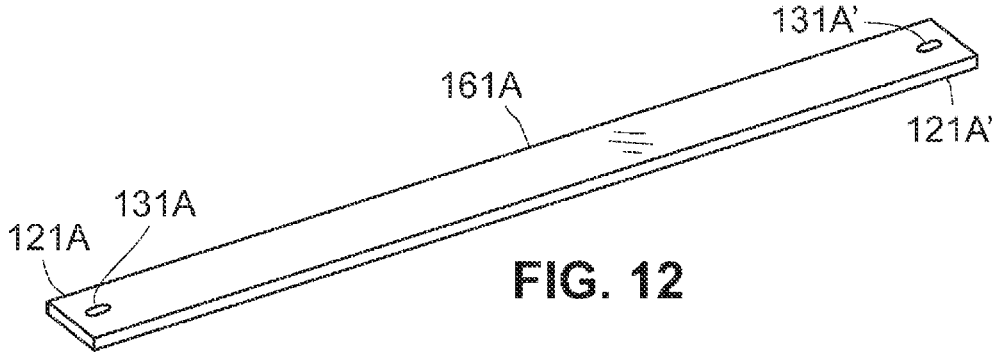
FIG. 12 is a perspective view showing a tie-bar with an oval-shaped hole near each of its ends.

FIG. 12 is a perspective view showing a tie-bar 161A with an oval-shaped hole 131A near the tie-bar end 121A, and an oval-shaped hole 131A' near the other tie-bar end 121A'. In this view, the tie-bar 161A is shown with its larger surfaces in a generally horizontal plane, as oriented in the embodiment of FIG. 1. However, tie-bars such as 161A can also be oriented with their larger surfaces in a generally vertical plane.

Figure 13:
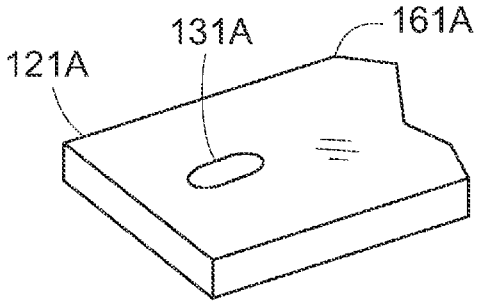
FIG. 13 is a close-up view of one of the ends of the tie-bar shown in FIG. 12.

FIG. 13 is a close-up view of the end 121A of the tie-bar 161A shown in FIGS. 1-2, 5-6, 9-11, and 12. One of the disadvantages of having a hole 131A near the end 121A of this tie-bar 161A is that sufficiently strong tension forces along the length of the tie-bar, when reacted against by forces in a coupling pin located in the hole 131A, can result in failure of the tie-bar around the pin. The end 121A can be made stronger by locating the hole farther away from the very end of the tie-bar and also by making the tie-bar wider and/or thicker (i.e. in directions lateral to the length of the tie-bar 161A).

Figure 14:
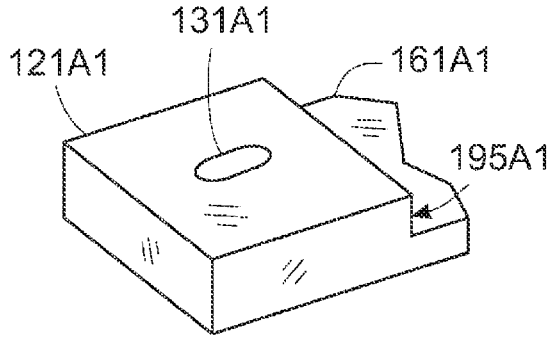
FIG. 14 is a perspective view of an end of a tie-bar that has it's thickness increased relative to the mid-portion of the tie-bar.

FIG. 14 is a perspective view of an end 121A1 of a modified tie-bar 161A1 that has it's thickness increased relative to that of the mid-portion of the tie-bar, requiring the hole 131A1' to be deeper than illustrated in the previous views, and resulting in a tie-bar end 121A1 that is stronger than that of tie-bar end 121A as shown in FIG. 13. Since only the end portion 121A1 is made thicker, it is then possible, without weakening the rest of the tie-bar, to have a shelf-like step feature 195A1. Depending upon how this step feature 195A1 is to be used in cooperation with alternative means for coupling, this step feature might have an abrupt step as illustrated or a gradual step as might be produced by a fillet of weld material.

Figure 15:
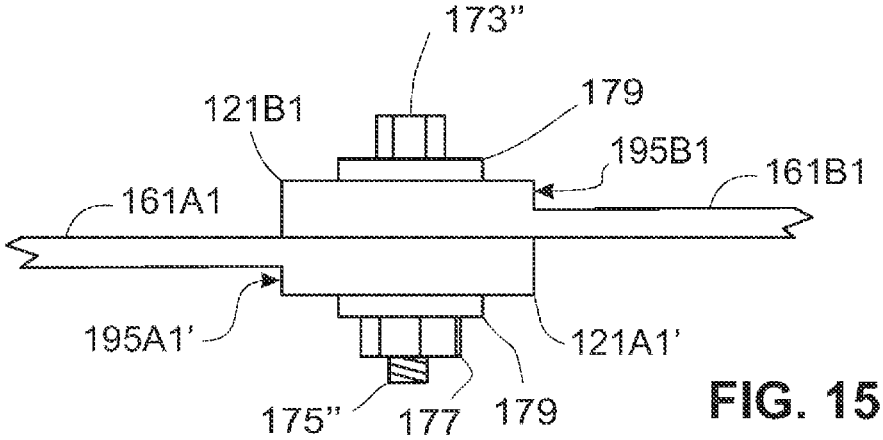
FIG. 15 is a front view showing one example of means for coupling two tie-bars end-to-end.

FIG. 15 is a front view (or top view in an alternative embodiment) showing one example of means for coupling two modified tie-bars 161A1 and 161B1 together end-to-end. Whereas a modified (shorter) coupling pin is shown here with head 173" and threads 175" and used with washers 179 and a nut 177, it will be readily appreciated by one skilled in the art that if the tie-bars 161A1 and 161B1 are to be oriented with their larger surfaces in a vertical plane, that multiple bolts could be used in place of a single coupling pin, and that this would provide equivalent means for coupling two tie-bars together. Since the tie-bars 161A1 and 161B1 have thicker ends 121A1' and 121B1, the coupling shown is a stronger one than if the tie-bars were not modified to have thicker ends and were the same thickness throughout their lengths as the thickness of the portions of the tie-bars 161A1 and 161B1 seen in this view to the left of the step feature 195A1' and to the right of step feature 195B1 respectively.

Figure 16:
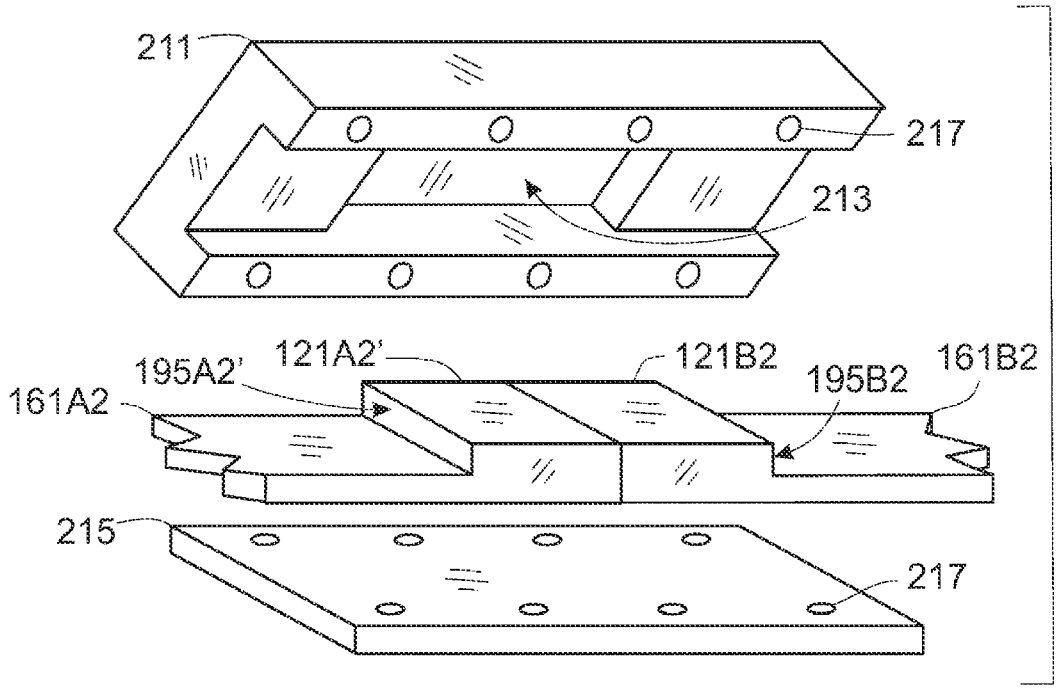
FIG. 16 shows a perspective view of two parts of an opened enclosure device that can be used to couple two tie-bars end-to-end.

FIG. 16 shows a perspective view of two enclosure parts 211 and 215 of an opened enclosure assembly that can be used, when closed and fastened to one another, to couple two modified tie-bars 161A2 and 161B2 at least approximately butt-end-to-butt-end without requiring any holes that would otherwise weaken the tie-bars 161A2 and 161B2. The tie-bar ends 121A2' and 121B2 are modified to have thicker ends than the middle portion of the tie-bars 161A2 and 161B2 respectively, and have to have step features 195A2' and 195B2 respectively. When the two enclosure parts 211 and 215 are brought together to enclose the ends 121A2' and 121B2 of the tie-bars 161A2 and 161B2, their inner shapes are made to conform generally to the shapes of the tie-bar ends 121A2' and 121B2, thus using the step features 195A2' and 195B2 to effectively lock the two tie-bars 161A2 and 161B2 together butt-end-to-butt-end, and thus coupling them together securely. The thicker portions created by the step features 195A2' and 195B2 of the ends 121A2' and 121B2 extend into a cavity or recess 213 in the enclosure part 211. Multiple holes 217 in both enclosure parts 211 and 215 are used with bolts to secure the two parts 211 and 215 together. One skilled in the art can appreciate that other embodiments can be configured in the same spirit as that illustrated here. For example, the tie-bars could be made even thicker with a step feature (such as 195A2' and 195B2) on both large faces of the ends of each tie-bar, and that the enclosure needed to attach them butt-end-to-butt-end could be made of two enclosure parts both having a respective recess such as part 211 shown. Another modification that can be made is to oversize the recess 213 to allow some play of the tie-bar ends 121A2' and 121B2 to rotate somewhat in a plane parallel to the larger faces of the tie-bars. And another modification can be to have step features on not one or two sides of an end portion of a tie-bar, but on all four sides of a tie-bar having a square or rectangular cross-section end and to enclose two such tie-bars into a coupling enclosure that has recesses to accommodate each of the step features.

Figure 17:
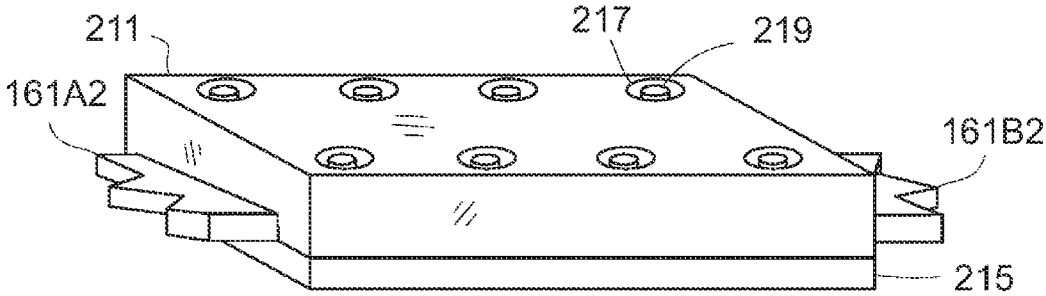
FIG. 17 shows a perspective view of the enclosure of FIG. 16 closed about the ends of two tie-bars and thus serving as means for coupling the two tie-bars together.

FIG. 17 shows a perspective view of the parts shown in FIG. 16 but wherein the two enclosure parts 211 and 215 are shown here as closed and fastened about the ends 121A2' and 121B2 of two tie-bars 161A2 and 161B2 and thus serving as means for coupling the two tie-bars 161A2 and 161B2 together.

Figure 18:
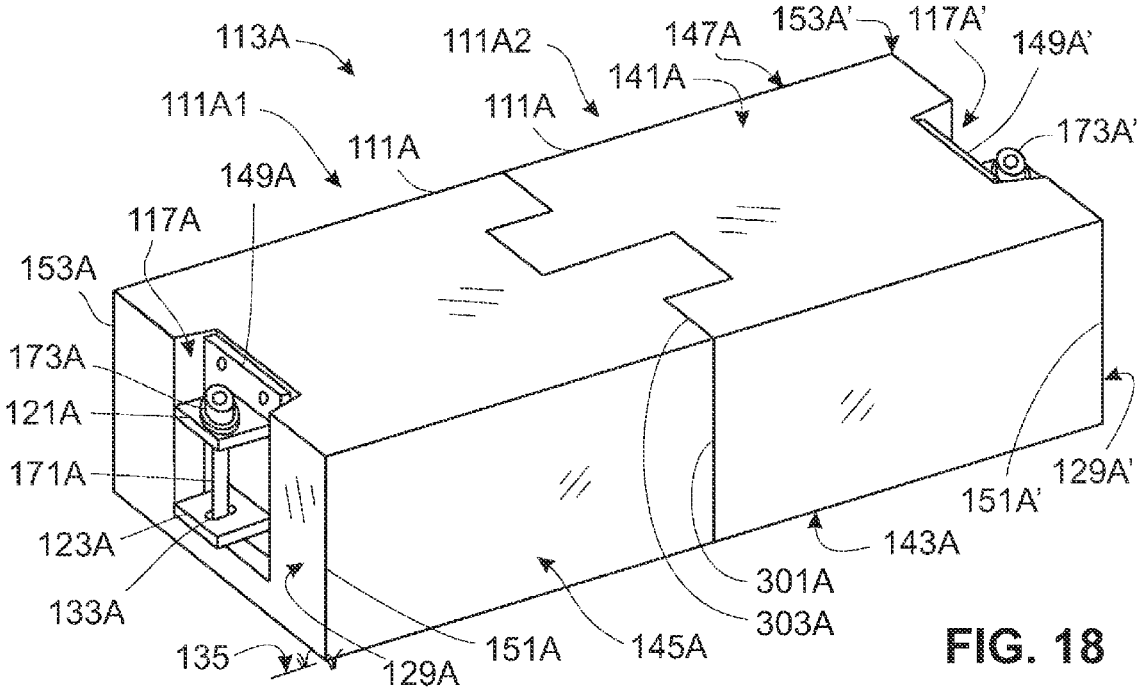
FIG. 18 shows an enlarged view of the barrier as seen on the left in FIG. 1, only its mass of solid material is modified to be comprised of two individual segments that key into one another.

FIG. 18 shows an enlarged view of the barrier 113A as seen on the left in FIG. 1, except the mass of solid material is shown here to be comprised of two individual segments 111A1 and 111A2 that key into one another. The two segments are shown as separate from one-another but touching one another along the dividing line 303A between segments, and along vertical edges 301A of the segments. The dividing line 303A generally has this shape throughout the heights of the segments, i.e. from top to bottom. Whether the mass of solid material 111A consists of two segments 111A1 and 111A2 (as seen here in FIG. 18), or consists of only one single mass of solid material (as shown in FIG. 1), is optional, but in either case it is comprised of tunnels that extend all the way from the cavity 117A on the left to the cavity 117A' on the right. One skilled in the art will readily appreciate that the dividing line 303A is only one configuration of many that could be used to shape the interfacing ends of the two segments 111A1 and 111A2 or "sub-blocks", and that the shape of the dividing line 303A shown here demonstrates a stepped-back-and-forth shape that can provide the interface with strength to resist shearing laterally and horizontally between the two sub-blocks. The shape of the dividing line 303A shown here can eliminate or at least reduce horizontal shear stress laterally. The tie-bar ends 121A and 123A of the tie-bars 161A and 163A are shown here on the left, but the tunnels 125A and 127A are not visible in this figure.

Figure 19:
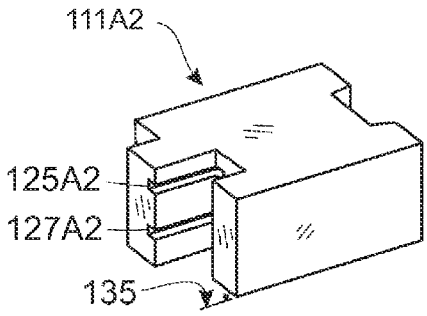
FIG. 19 shows one of the segments of the barrier of FIG. 18, designed with tunnels for tie-bars.

FIG. 19 shows one segment 111A2 of the two segments 111A1 and 111A2 of the barrier 113A of FIG. 18, designed with tunnels 125A2 and 127A2 for tie-bars. Channels that are the extensions of the tunnels 125A2 and 127A2 are visible in this view and given the call-out designations of the tunnels since when interfaced with the other segment 111A1, these channels complete mid-portions of the tunnels 125A2 and 127A2 by aligning with similar channels in the other segment 111A1. It can be readily appreciated by one skilled in the art that the dividing line 303A shown in FIG. 18 is one that permits the two segments 111A1 and 111A2 to be symmetrical and therefore identical, and that this reduces the need for manufacturers to make two different types of segments.

Figure 20:
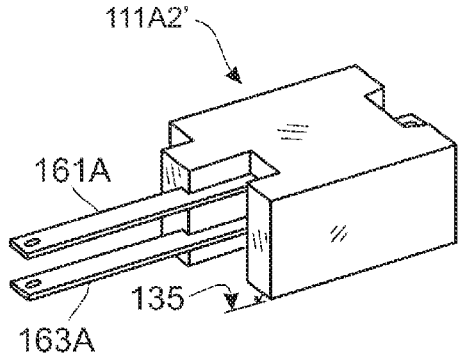
FIG. 20 shows a modified version of the segment of barrier shown in FIG. 19, designed without tunnels and having tie-bars cast in place within the segment.

FIG. 20 shows a modified version 111A2' of the segment 111A2 shown in FIG. 19, designed without tunnels and having tie-bars 161A and 163A cast in place within the segment 111A2'. Such a modified segment 111A2' can be interfaced with a segment such as 111A2 shown in FIG. 19. One skilled in the art can readily appreciated that such a combination of segments 111A2 and 111A2' can permit a complete barrier in which a means for retaining coupling devices are not required as the tie-bars are cast within the segment 111A2'.

One skilled in the art will readily appreciate that the installation and assembly of a security wall such as illustrated in FIG. 1, if involving larger numbers of barriers than merely two, can involve placing into location and coupling one additional barrier at a time, either always at the same one end of a row or at either end of a row, or placing into location a group of adjacent barriers and proceeding to couple selected adjacent pairs sequentially down the row or in any order of sequence.

One skilled in the art will appreciate that other structure for means for coupling and arrangements of one or more tie-bars in massive barriers can be used. One example would be the rotation of the tie-bar(s) 90 degrees about their longitudinal axes and coupling them with one or more pins or bolts and nuts, in which case any mutual rotation of adjacent barriers would incur bending of the tie-bars near the cavities as portions of the mass of solid material that interfere with the rotation break away. Other examples would include, but not be limited to, the use of clamping devices, couplings as used to couple railway cars together, interlocking mechanisms, mechanisms such as used to hook a trailer to a tractor, and equivalent linking devices used to attach two bodies to one another and allow some relative mutual rotation between the two bodies. Such alternative embodiments for coupling devices are considered herein to be other equivalents of means for coupling barrier blocks together.

One skilled in the art will appreciate that other means for retaining can be used than those described above. Since the purpose of a retainer in this invention is to constrain the end(s) of one or more tie-bars from being pulled into a tunnel, and possibly also to constrain the end(s) from translating laterally relative to a nearby tunnel entrance, it can be appreciated by one skilled in the art that equivalent means for retaining can be any retainer device that can serve as an obstruction to an end of one or more tie-bars (or to a coupling means to which the tie-bar end(s) is/are attached) in either or both the lateral and longitudinal directions. If it is to provide restraint in the lateral direction, such obstruction would at least resist lateral movement of a tie-bar end from moving outsides of the cavity in a barrier within which it was installed. If it is to provide restraint in the longitudinal direction, such an obstruction would at least resist longitudinal movement of a tie-bar end from moving into a tunnel. One skilled in the art will readily appreciate that if the structure of means for coupling is larger laterally than the entrance to a tunnel, or larger enough to restrict lateral motion within a cavity of a barrier into which it is installed, then it can serve in either case respectively as means for retaining in the longitudinal or lateral directions. And one skilled in the art will readily appreciate that structures of means for coupling that simultaneously couple multiple tie-bars of one barrier to those of an adjacent barrier intrinsically serve as means for retaining. It is therefore intended that all such equivalents of means for coupling and means for retaining should be considered equivalents to those illustrated in the drawings and previously disclosed in this specification.

One skilled in the art will appreciate that shapes for the mass of solid material comprising a barrier can be other than that shown in the illustrated embodiments within this specification. For example, the sides of the barrier blocks can be made in a shape that permits features in the side of one barrier block to key into complementary features in the oppositely facing side of an adjacent barrier block, this to strengthen shear resistance to resist lateral displacements between adjacent barriers and thus potentially reduce the shear forces experienced by coupling devices when a security wall experiences a terrorist event intended to breach the wall. In another example, the opposite sides of a barrier block don't necessarily have to be parallel, but could be at an angle to one another as to accommodate a change of longitudinal direction somewhere along a row of barriers.

Under "Objects and Advantages of the Invention" presented above, it was stated that the invention comprises barrier blocks that have bottoms that are resistant to sliding over the ground (or over another supporting surface), that the bottom of a block should have a high coefficient of friction with the supporting surface. One skilled in the art will readily appreciate that the energy required to move or otherwise slide a block over a supporting surface can be effectively increased with some types of supporting surfaces by incorporating a tread-like surface or even cleats or spikes on the bottom of barrier blocks. Where it is known that there are no underground utilities to be damaged, ground anchors (e.g. piers)

can be used to anchor barriers firmly to the ground at some locations along a wall, but still allowing other locations to slide. Barrier blocks or tie-bars can be tethered loosely to ground anchors by means of cables having a fixed length of slack and thereby designed to bring a moving wall to an earlier halt than otherwise after a given distance of sliding, or even tethered taught with a frictional braking means to feed out cable while absorbing kinetic energy from the wall as it is dragged from its installed position.

Although specific embodiments have been illustrated and described herein, those of ordinary skill in the art will appreciate that any arrangement configured to achieve the same purpose may be substituted for the specific embodiments shown. This disclosure is intended to cover any and all adaptations or variations of various embodiments of the invention. It is to be understood that the above description has been made in an illustrative fashion, and not a restrictive one. Combinations of the above embodiments, and other embodiments not specifically described herein will be apparent to those of skill in the art upon reviewing the above description. The scope of various embodiments of the invention includes any other applications in which the above structures and methods are used. Therefore, the scope of various embodiments of the invention should be determined with reference to the appended claims, along with the full range of equivalents to which such claims are entitled.

We claim:

1. A massive security barrier module comprising:

a) a mass of solid material having a slidable bottom surface, wherein the mass has two opposite sides, a front, and a back, wherein each side has a front edge near the front, wherein each side has a back edge near the back, wherein each of the two opposite sides each contains one of a pair of opposite cavities, wherein the mass of solid material comprises at least two individual segments, and wherein at least one tunnel extends at least partially between the pair of opposite cavities and through at least a first one of the two individual segments;

b) at least one tie-bar extending through the tunnel and into the cavities;

c) means for coupling the tie-bar to other tie-bars of similar and adjacent massive security barrier modules, the adjacent massive security barrier modules being side-against-side with said massive security barrier module, and the other tie-bars retained at sides that are remote from the sides of said massive security barrier module; and d) means for retaining said means for coupling from entry into the tunnel;

whereby the massive security barrier module has sufficient strength to maintain attachment with the adjacent massive security barrier modules when said massive security barrier module is subjected to an external impulsive force from a terrorist act sufficiently strong to rotate the modules relative to one another and cause at least one of the edges that structurally interferes with that rotation to break; and whereby energy from a security-threat event is absorbed by the break and further attenuated by the bottom surface of said massive security barrier module sliding across a supporting surface.

2. The massive security barrier module of claim 1; wherein the two individual segments key into one-another.

3. The massive security barrier module of claim 1; wherein the two individual segments have the same shape as one-another.

4. The massive security barrier module of claim 1; wherein at least one instance of said means for coupling can be comprised of one selected from the group consisting of a pin, a bolt, and an enclosure.

5. The massive security barrier module of claim 1; wherein at least one instance of said means for coupling comprises an instance of said means for retaining.

6. The massive security barrier module of claim 1; wherein said tie-bar is cast into the first one of the two individual segments.

7. The massive security barrier module of claim 6; wherein the first one of the two individual segments comprises an instance of said means for retaining.

8. A massive security barrier module comprising:

a) a mass of solid material having a slidable bottom surface, wherein the mass has two opposite sides, a front, and a back, wherein each side has a front edge near the front, wherein each side has a back edge near the back, wherein each of the two opposite sides each contains one of a pair of opposite cavities, wherein the mass of solid material comprises at least two individual segments, and wherein at least one tunnel extends at least partially between the pair of opposite cavities and through at least a first one of the two individual segments;

b) at least one tie-bar extending through the tunnel and into the cavities;

c) at least one coupling device for coupling the tie-bar to another tie-bar of a similar and adjacent massive security barrier module, the adjacent massive security barrier module being side-against-side with said massive security barrier module, and said another tie-bar retained at a side that is remote from the sides of said massive security barrier module; and d) at least one retaining device for retaining said at least one coupling device from entry into the tunnel;

whereby the massive security barrier module has sufficient strength to maintain attachment with the adjacent massive security barrier module when said massive security barrier module is subjected to an external impulsive force from a terrorist act sufficiently strong to rotate the modules relative to one another and cause at least one of the edges that structurally interferes with that rotation to break; and whereby energy from a security-threat event is absorbed by the break and further attenuated by the bottom surface of said massive security barrier module sliding across a supporting surface.

9. The massive security barrier module of claim 8; wherein the two individual segments key into one-another.

10. The massive security barrier module of claim 8; wherein the two individual segments have the same shape as one-another.

11. The massive security barrier module of claim 8; wherein the coupling device is comprised of one selected from the group consisting of a pin, a bolt, and an enclosure.

12. The massive security barrier module of claim 8; wherein the coupling device comprises the retaining device.

13. The massive security barrier module of claim 8; wherein said tie-bar is cast into the first one of the two individual segments.

14. The massive security barrier module of claim 13; wherein said first one of the two individual segments is the retaining device.

15. A barrier module comprising:

a) a mass of solid material having a slidable bottom surface, wherein the mass has two opposite sides each having at least one vertical exterior edge and one of a pair of opposite cavities, wherein the mass of solid material comprises at least two individual segments, and wherein at least one tunnel extends at least partially between the pair of opposite cavities and through at least a first one of the two individual segments;

b) at least one tie-bar extending through the tunnel and into the cavities;

c) at least one coupling device for coupling the tie-bar to another tie-bar of a similar and adjacent barrier module, the adjacent barrier module being side-against-side with said barrier module, and said another tie-bar retained at a side that is remote from the sides of said barrier module; and d) at least one retaining device for retaining said at least one coupling device from entry into the tunnel;

whereby the barrier module has sufficient strength to maintain attachment with the adjacent barrier module when said barrier module is subjected to an external impulsive force from a terrorist act sufficiently strong to rotate the modules relative to one another and cause at least one of the edges that structurally interferes with that rotation to break; and whereby energy from a security-threat event is absorbed by the break and further attenuated by the bottom surface of said barrier module sliding across a supporting surface.

16. The barrier module of claim 15; wherein the two individual segments key into one-another.

17. The barrier module of claim 15; wherein the two individual segments have the same shape as one-another.

18. The barrier module of claim 15; wherein the coupling device is comprised of one selected from the group consisting of a pin, a bolt, and an enclosure.

19. The barrier module of claim 15; wherein the coupling device comprises the retaining device.

20. The barrier module of claim 15; wherein said tie-bar is cast into the first one of the two individual segments.

* * * * *